United States Patent [19]

Loo

[11] 4,149,879

[45] Apr. 17, 1979

[54] RECOVERY OF MERCURY AND CAUSTIC VALUES FROM CAUSTIC SLUDGES

[75] Inventor: Wing M. Loo, Cleveland, Tenn.

[73] Assignee: Olin Corporation, New Haven, Conn.

[21] Appl. No.: 782,678

[22] Filed: Mar. 30, 1977

[51] Int. Cl.[2] ..... C22B 43/00; C01D 1/04

[52] U.S. Cl. ..... 75/97 A; 75/81; 75/121; 423/107; 423/109; 423/208

[58] Field of Search ..... 423/205, 208, 107, 109, 423/180; 75/121, 97 A, 81; 204/99

[56] References Cited

U.S. PATENT DOCUMENTS

| | | | |
|---|---|---|---|
| 2,837,408 | 6/1958 | Sakowski | 423/180 |
| 3,536,597 | 10/1970 | Yamori et al. | 204/99 |
| 3,691,037 | 9/1972 | Updyke | 204/99 |
| 4,087,276 | 5/1978 | Generini | 75/81 |

FOREIGN PATENT DOCUMENTS

| | | | |
|---|---|---|---|
| 30-8271 | 11/1955 | Japan | 75/81 |

*Primary Examiner*—Brian Hearn

*Attorney, Agent, or Firm*—James B. Haglind; Donald F. Clements

[57] ABSTRACT

Mercury and caustic values are recovered from caustic sludges in a process which comprises intermixing the caustic sludge with a liquid under pressure or agitation to produce a caustic slurry which is separated into a caustic liquor, metallic mercury and a remaining sludge which is suitable for roasting in a retort to recover better than 99 percent of the mercury in the sludge.

The process recovers valuable mercury and caustic materials and eliminates pollution of natural resources which was formerly caused when these sludges were disposed of in landfill operations. In addition, the process reduces potential hazards to personnel handling the caustic sludges and requires no addition of chemicals which produce undesirable by-products and add to the cost of the recovery process.

9 Claims, 1 Drawing Figure

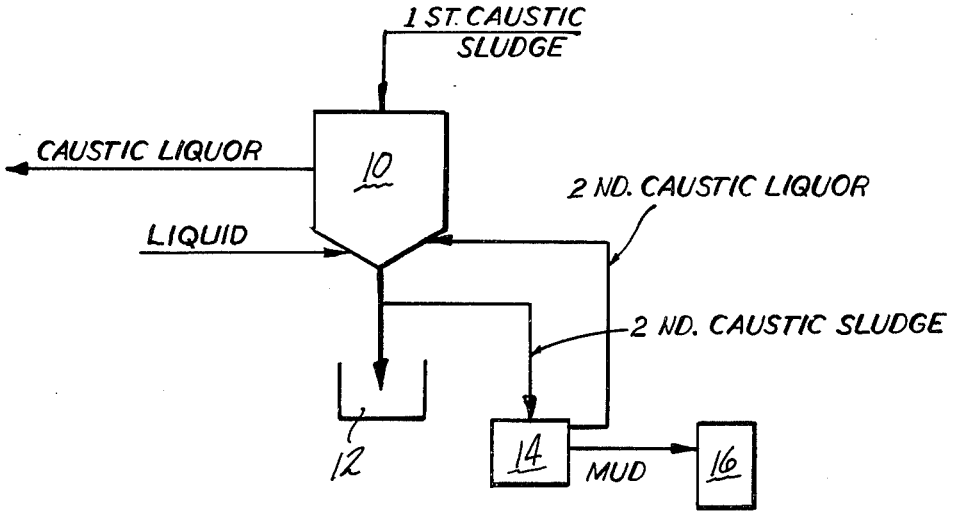
1 ST. CAUSTIC SLUDGE
CAUSTIC LIQUOR
10
2 ND. CAUSTIC LIQUOR
LIQUID
2 ND. CAUSTIC SLUDGE
12
14
MUD
16

RECOVERY OF MERCURY AND CAUSTIC VALUES FROM CAUSTIC SLUDGES

This invention relates to a process for recovering mercury. More specifically, this invention relates to a process for recovering mercury from caustic sludges produced during the electrolysis of brines in mercury cathode electrolytic cells.

During the production of chlorine and alkali metal hydroxides by electrolysis of alkali metal chloride brines in a cell using a mercury cathode, waste materials are accumulated which contain high concentrations of the alkali metal hydroxide and metallic mercury in a semi-solid or sludge form.

In the past, these waste materials have been disposed of, for example, in land fill operations. This method of waste treatment results in a considerable economic loss of both product and raw material, in addition to causing pollution of natural resources.

Furthermore, there is a danger of injury to personnel handling these wastes, both from caustic burns and from possible contamination by mercury.

In addition, sludges containing high caustic concentrations have high freezing points, for example, about 50° F. for a sludge containing 50 percent NaOH, posing a problem for equipment used in processing or storing the sludge.

In the treatment of mercury-containing waste materials, one widely used method is to heat the mercury-containing waste in a rotort to recover the metallic mercury. However, caustic sludges, such as those obtained from a filter for concentrated caustic solutions or from an amalgam decomposer, cannot be fed to a retort without causing corrosive damage to the equipment.

Therefore, there is need for a process of treating mercury-containing sludges which permits recovery of economically valuable materials while reducing the pollution of natural resources.

It is an object of the present invention to provide a process for the treatment of mercury-containing caustic sludges which permits the recovery of mercury values.

Another object of the present invention is to provide a process for the treatment of mercury-containing caustic sludges which permits the recovery of caustic values.

A further object of the present invention is to provide a process for the treatment mercury-containing caustic sludges which substantially eliminates the pollution of natural resources.

An additional object of the invention is to provide a process for the treatment of mercury-containing caustic sludges which greatly reduces hazards to personnel handling these wastes.

These and other objects of the present invention are accomplished in a process for the treatment of mercury-containing caustic sludges which comprises:

(a) intermixing a liquid selected from the group consisting of water and a dilute caustic solution with a first caustic sludge to form a caustic slurry, (b) separating the caustic slurry into a caustic liquor, a second caustic sludge and metallic mercury, (c) recovering the metallic mercury, (d) recovering the caustic liquor, and (e) introducing the second caustic sludge into a retort for mercury recovery.

The accompanying FIGURE represents a flow diagram of the process of the present invention.

As illustrated, a first caustic sludge is introduced into vessel 10. Liquid is fed through an opening in the bottom of vessel 10 to flow up through the caustic sludge to form a slurry containing metallic mercury, caustic liquor, and solids. After separation, metallic mercury is withdrawn and introduced into vessel 12. Caustic liquor is removed through an opening in the upper portion of vessel 10. The remaining sludge is fed as second caustic sludge to vessel 14. After separation, additional caustic liquor is removed through an opening in the upper portion of vessel 14 and recycled to vessel 10. The mud remaining in vessel 14 is fed to retort 16 for the recovery of any remaining mercury.

Mercury-containing caustic sludges treated by the novel process of the present invention can be obtained from several operations which are conducted during the electrolysis of alkali metal chloride brines in mercury cathode electrolytic cells. These operations include the filtering of caustic solutions containing, for example, geater than about 40 percent by weight of the alkali metal hydroxide produced by the decomposition of alkali metal amalgams.

Caustic sludges which are treated have a concentration of form about 12 to about 50 percent by weight of an aqueous alkali metal hydroxide solution and a solids content of from about 50 to about 85 percent by weight. The amount of mercury contained in the sludges varies, but it may normally have a mercury concentration of form about 15 to about 15 percent by weight.

The sludges may also contain materials such as carbon, where, for example, it is used in the decomposition of the alkali metal amalgams or filter aids used in the filtering process.

Caustic sludges containing mercury are introduced into a suitable vessel such as a holding tank. A liquid such as water or a dilute caustic solution is admixed with the sludge to produce a slurry which permits the release of metallic mercury and the formation of a caustic liquor. The liquid can be added to the vessel and sufficient mechanical agitation provided so that the mercury and caustic can be freed from the sludge. In a preferred embodiment, the liquid is supplied to the vessel under a pressure of from about 40 to about 90 psig, and preferably from about 60 to about 70 psig.

In one embodiment, the liquid is the water which is used in backwashing the filter for filtering a solution containing about 50 percent by weight of alkali metal hydroxide. Upon backwashing the filter with deionized water, a dilute caustic solution is obtained which is pumped into the tank containing the sludge. Preferably, it is forced by pressure through an opening in the bottom of the tank up through the caustic sludge.

Following addition of the liquid, the slurry is separated to recover the metallic mercury and the caustic liquor produced, from the remaining sludge. Any suitable means may be used such as filtering, centrifuging, or permitting the slurry to settle, for example, for a period of from about 4 to about 48 hours.

Where the slurry is centrifuged or allowed to to settle, metallic mercury, which settles to the bottom of the vessel, is drawn off. The mercury is sufficiently pure so that it can be returned to the cell without further treatment.

A caustic liquor containing from about 12 to about 20 percent by weight of alkali metal hydroxide is recovered, for example, by decanting, from the upper portion of the separation vessel. This caustic liquor can be used, for example, in the treatment of alkali metal chloride brine which is electrolyzed in the mercury cells.

The caustic sludge remaining in the tank, which has been reduced to less than about 25 percent of the original volume, can be removed and fed to a retort for the recovery of any remaining mercury. The caustic concentration has been reduced to where it will not cause substantial corrosion when heated in the retort.

In a preferred embodiment, this caustic sludge receives a secondary treatment to further reduce the caustic content and volume of sludge and to recover additional caustic liquor. This secondary treatment may be applied to the sludge in the original vessel, or prior to the secondary treatment, the sludge may be introduced into another vessel. The caustic sludge is centrifuged or, for example, allowed to settle for a period of from about 2 to about 7 days, depending on the amount of sludge handled. The caustic liquor, which has the same concentration range as that obtained previously, is decanted and may be added to the caustic liquor previously recovered, or preferably may be recycled to treat additional caustic sludge. The remaining mud which is now less than about 10 percent of the original volume, is fed to a retort.

The following example is presented to illustrate the invention more fully. All parts and percentages are by weight unless otherwise indicated.

EXAMPLE

Caustic sludge (375 gallons) from a filter for 50 percent NaOH solution was introduced under air pressure (70 psig) into a holding tank. The sludge was primarily a mixture of sodium hydroxide, metallic mercury (40 lbs.), and water with minor amounts of carbon and cellulose. The filter was backwashed with water and the water forced by air pressure through an opening in the bottom of the tank up through the caustic sludge to produce a caustic slurry. After a total of about 1125 gallons of water had been added, the slurry was allowed to settle for a period of about 24 hours. Metallic mercury was drained through an opening in the bottom of the tank into a container. A caustic liquor containing 20 percent by weight of NaOH was removed through an outlet in the side of the tank. The sludge remaining (60 gallons) in the holding tank was drained from the tank into two drums where the sludge was allowed to settle for a period of five days. A steam evactor hose was inserted in each of the drums to aid in removing the caustic liquor. Following removal of the 20 percent caustic liquor, the sludge (about 30 gallons) was fed to a retort to recover any remaining mercury. In the retort, the sludge was heated to 800° F. and held for a period of about 5 hours at that temperature. The amount of metallic mercury recovered was greater than 39.9 lbs.

What is claimed is:

1. A process for the treatment of mercury-containing caustic sludges obtained from a filter for caustic solutions or from an amalgam decomposer which comprises:

(a) intermixing a liquid selected from the group consisting of water and a dilute caustic solution with a first caustic sludge in a first vessel to form a caustic slurry, (b) separating said caustic slurry into a caustic liquor, a second caustic sludge, and metallic mercury, (c) recovering said metallic mercury, (d) recovering said caustic liquor, and (e) introducing said second caustic sludge into a retort for mercury recovery.

2. The process of claim 1 in which said intermixing comprises forcing said liquid through said caustic sludge under pressure.

3. The process of claim 2 in which said liquid is at a pressure of from about 60 to about 70 psig.

4. The process of claim 2 in which said first caustic sludge has a concentration of from about 12 to about 50 percent by weight of an aqueous alkali metal hydroxide solution.

5. The process of claim 4 in which said liquid is at a pressure of from about 40 to about 90 psig.

6. The process of claim 1 in which said first caustic sludge is obtained from a caustic filter.

7. The process of claim 4 in which said liquid is water used to backwash said caustic filter.

8. A process for the treatment of mercury-containing caustic sludges which comprises:

(a) intermixing a liquid selected from the group consisting of water and a dilute caustic solution with a first caustic sludge in a first vessel to form a caustic slurry, (b) separating said caustic slurry into a caustic liquor, a second caustic sludge, and metallic mercury, (c) recovering said metallic mercury, (d) recovering said caustic liquor, (e) feeding said second caustic sludge to a second vessel and separating said second caustic sludge into mud and a second caustic liquor, (f) recovering said second caustic liquor, and (g) introducing said mud into a retort for mercury recovery.

9. The process of claim 8 in which said second caustic liquor is recycled to said first vessel to intermix with said first caustic sludge.

* * * * *